United States Patent [19]

Solvi et al.

[11] Patent Number: 4,767,258

[45] Date of Patent: Aug. 30, 1988

[54] PROCESS AND APPARATUS FOR CHARGING A SHAFT FURNACE

[76] Inventors: Marc Solvi, 56 route des 3 Cantons, Ehlange s/Mess; Gilbert Bernard, 6 rue Robert Schuman, Helmdange; Emile Lonardi, 30 rue de Schouweiler, Bascharage, all of Luxembourg

[21] Appl. No.: 860,653

[22] Filed: May 7, 1986

[30] Foreign Application Priority Data

May 7, 1985 [LU] Luxembourg ..... 85879
Mar. 4, 1986 [LU] Luxembourg ..... 86340

[51] Int. Cl.[4] ..... B05G 65/00

[52] U.S. Cl. ..... 414/786; 414/328; 414/294; 414/21; 222/56

[58] Field of Search ..... 222/52, 56, 58; 414/328, 21, 288, 294, 295, 786, 199, 200

[56] References Cited

U.S. PATENT DOCUMENTS

| | | | |
|---|---|---|---|
| 2,903,144 | 9/1959 | Stock | 414/199 X |
| 4,071,166 | 1/1978 | Legille et al. | 414/21 X |
| 4,395,179 | 7/1987 | Berzins | 414/161 |

FOREIGN PATENT DOCUMENTS

| | | |
|---|---|---|
| 3007743 | 9/1981 | Fed. Rep. of Germany . |
| 983066 | 2/1951 | France . |
| 2062211 | 6/1971 | France . |
| 2174999 | 3/1973 | France . |
| 2224370 | 4/1973 | France . |
| 2106064 | 4/1983 | United Kingdom . |
| A96769 | 6/1981 | U.S.S.R. . |

*Primary Examiner*—Joseph Falk
*Attorney, Agent, or Firm*—Fishman, Dionne & Cantor

[57] ABSTRACT

A process and apparatus for charging a shaft furnace is presented which ensures the vertical and symmetrical fall of charging material from a hopper onto a distribution spout. The discharge valve of the hopper and the valve of a chamber feeding material to the hopper are regulated in such a way as to form a barrage in the base of the hopper. To control the formation of this barrage, and ensure that it will be maintained throughout a charging phase, the hopper and the chamber are weighed separately, signals being produced for the control of dosing valves. In a preferred embodiment of an apparatus for performing this process, the hopper is rotated in order to reduce segregation of the charge material particles.

6 Claims, 3 Drawing Sheets

20
28
24
22
16
30
26
14
18
32
12
10
0

PROCESS AND APPARATUS FOR CHARGING A SHAFT FURNACE

BACKGROUND OF THE INVENTION

This invention relates to a process and apparatus for charging a shaft furnace with a charging installation comprising a rotary or oscillating spout The discharge aperture of the discharge pipe is controlled by a dosing device operating symmetrically about the central axis of the shaft furnace and being surmounted by at least one chamber, the chamber being provided with an upper and a lower sealing valve; and also a dosing device for regulating the rate of discharge to the hopper.

The conventional and well-known charging installations having rotary or oscillating spout comprise two side by side chambers which alternately operate. It is well known that these installations suffer from the drawback of an asymmetrical fall of charge material on the spout, due to the eccentric position of the chambers in relation to the central axis of the furnace. In order to remedy this drawback, a number of systems have been proposed to rectify or alter the undesirable falling trajectory of the charge material.

SUMMARY OF THE INVENTION

The above-discussed and other problems and deficiencies of the prior art are overcome or alleviated by the process and apparatus for a charging installation of the present invention which will enable the charging material to fall vertically and symmetrically onto the rotary or oscillating spout.

In accordance with the apparatus of the present invention, a shaft furnace charging installation is provided comprising a rotary or oscillating distribution spout and a hopper with a central discharge aperture positioned above the spout. The discharge aperture is controlled by a dosing device acting symmetrically about the central axis of the furnace and which is surmounted by two storage chambers, juxtaposed on each side of the vertical axis of the furnace and supported via balances. The chambers are provided with discharge pipes directed towards the hopper, a pair of sealing valves, and a pair of dosing valves associated respectively with the discharge pipes. The dosing valves enable the chambers to alternately communicate with the interior of the shaft furnace. An important feature of the present invention is that the hopper is contained in a tight carcase into which the discharge pipes extend. Also significant is that the hopper is suspended from the carcase via pressure cells. Means are provided outside the carcase to cause the hopper to rotate about the axis of the furnace; and to actuate its dosing device via the central suspension system of the hopper.

The dosing device of the hopper preferably comprises vertically movable element defining (with the wall of the hopper) an annular discharge aperture. The cross section of this annular discharge aperture may be varied by vertically moving the element.

The suspension system of the hopper is formed by a vertical cylinder passing axially through a bellows-type sealing device in the upper portion of the carcase. The cylinder is supported by pressure cells resting on the carcase. A hollow bar is positioned coaxially in the cylinder, the lower portion of this bar being connected via one or more cross bars to the hopper; while its upper portion is subjected, outside the carcase, to the action of a driving means in order to cause it to rotate about the vertical axis of the furnace. The upper portion of the hollow bar is also subjected to a second bar passing coaxially through the hollow bar, the lower portion of this second bar being connected to the dosing device, while its upper portion is subjected, outside the carcase, to the action of a jack in order to move the second bar and the dosing device in a vertical direction.

The external cylinder of the suspension system of the hopper is preferably connected to the carcase by flexible horizontal stabilization elements which do not interfere with the vertical freedom of movement of the hopper suspension system. The dosing valve of the chamber is initially opened in order to enable a sufficient quantity of material to flow out for the creation of a barrage of material above the discharge pipe of the hopper. The dosing valve of the hopper is opened after the barrage has been formed. Both the hopper, and the chamber which communicate with it, are weighed separately and throughout the charging period. Signals are produced which represent, respectively, the contents of the hopper, the contents of the chamber and the sum of the contents of the chamber and hopper.

The above discussed and other features and advantages of the present invention will be understood and appreciated by those skilled in the art from the following detailed description and drawings.

BRIEF DESCRIPTION OF THE DRAWINGS

Referring now to the drawings, wherein like elements are numbered alike in the several FIGURES

DESCRIPTION OF THE PREFERRED EMBODIMENT

Figure 1:
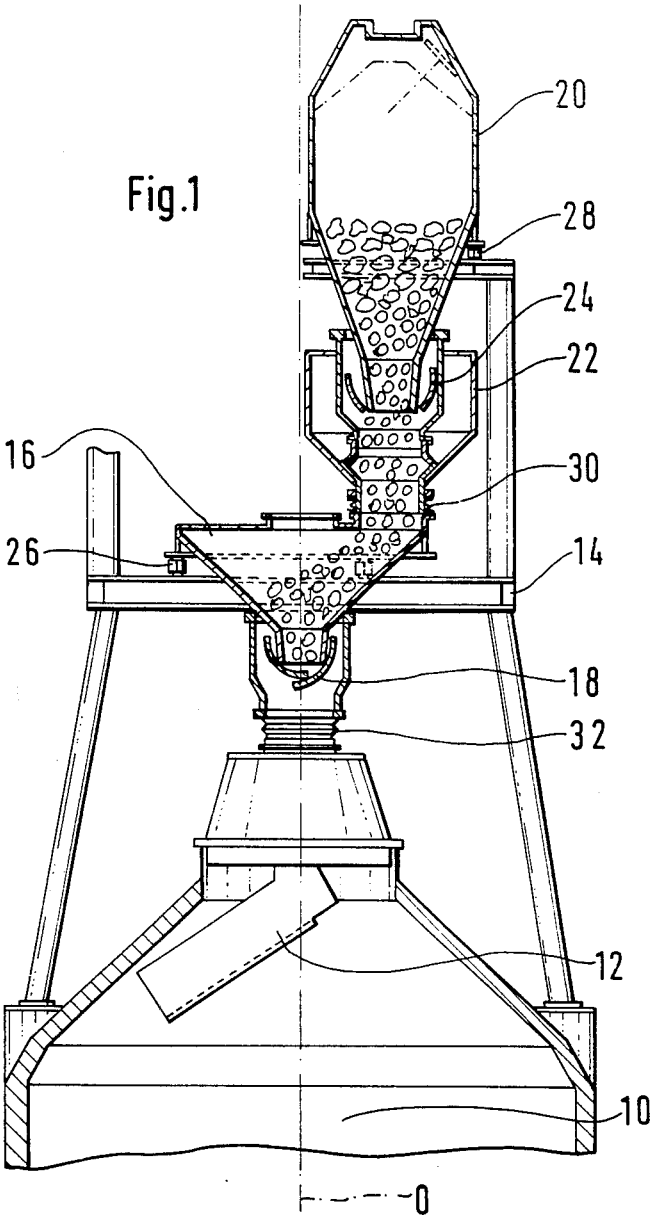
FIG. 1 is a schematic said view, partly in cross section, of a charging installation with a hopper for the formation of a barrage of charging material in accordance with the present invention.

FIG. 1 shows the upper portion of a blast furnace 10 in the head of which is mounted a rotary distributing spout 12. The discharge angle of spout 12 may be adjusted. Above furnace 10 is a frame 14 supporting the feed installation which comprises, among other components, a hopper 16 of which the discharge aperture is positioned above the spout 12 on the central axis 0. This discharge aperture is controlled by a dosing device 18 comprising two registers acting symmetrically about axis 0. Frame 14 also supports one or more chambers of which only one (identified at 20) is shown in the drawing. Chamber 20 is in communication with hopper 16 via a valve cage 22 which comprises a sealing valve (not shown) and a dosing valve 24 controlling the outflow of material from chamber 20. Dosing valve 24 is similar to valve 18.

In accordance with a first embodiment of the present invention, hopper 16 rests on a pre-selected number of pressure cells 26, cells 26 providing continuous signals. These signals represent the weight of the hopper 16 and its contents. Similarly, chamber 20 rests on a pre-selected number of pressure cells 28 which provide signals representing the contents (weight) of chamber 20. To enable hopper 16 and chamber 20 to be weighed separately, compensators 30 and 32 have been provided on each side of hopper 60 in order to separate it from the chamber and from the furnace.

A charging phase will now be described by reference to FIGS. 1 and 2. It will be appreciated that "charging phase" means the operation of depositing an even layer of a weight $P_O$ on the charging surface in the furnace 10. At the commencement of the charging phase, the entire quantity of charging material with weight $P_O$ is present in chamber 20, (with dosing valve 24 still being closed). Hopper 16, which is empty, is likewise closed by its dosing valve 18.

The simplest and most preferred process in the embodiment shown in FIG. 1 is for valve 24 to function as a check valve, which is completely opened in order to enable the charge material to flow into hopper 16 until the flow comes to a natural stop (this situation being shown in FIG. 1). The dosing operation is then effected by valve 18, and the material descends, without falling, from chamber 20 through cage 22 into hopper 16 (as and when it flows out of the latter).

It will be appreciated that alternatively, a barrage of reduced height may be formed which does not extend into chamber 20. In that case, valve 24 must be used as a dosing valve so as to regulate the flow of charge material from chamber 20, in such a way as to ensure that the barrage will be maintained in hopper 16.

Figure 2:
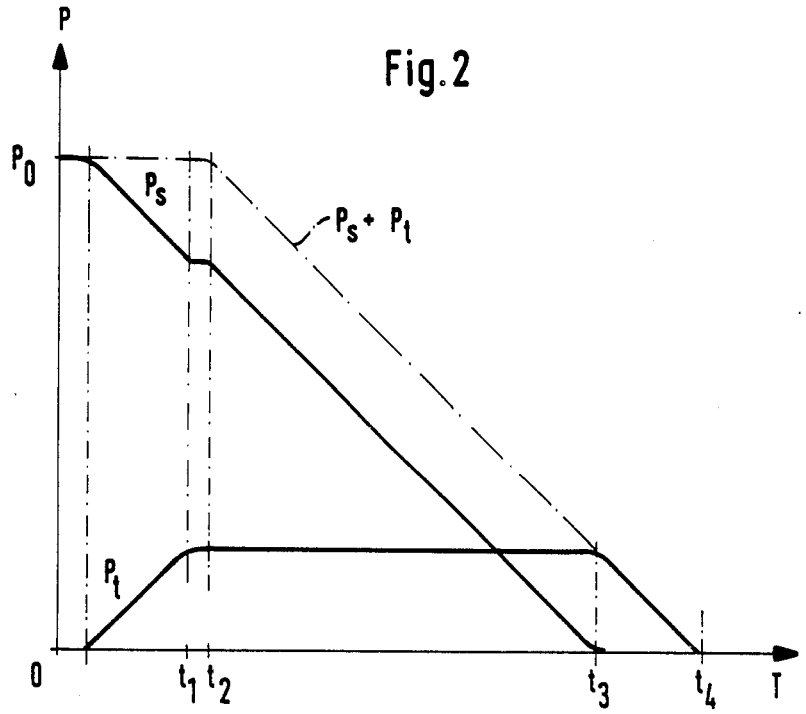
FIG. 2 is a graph showing the changes undergone in the weight of a chamber of the hopper in the course of the charging process in accordance with the present invention.

In FIG. 2, the curves $P_t$ and $P_s$ represent, respectively, the weight of the contents of hopper 16 and the weight of the contents of chamber 20. It shows the changes undergone by the weight of these contents over time T.

At the moment $T=0$, the weight $P_s$ is equal to $P_0$, while the weight $P_t$ is equal to 0. As soon as dosing valve 24 of chamber 20 is opened, a linear decrease takes place in the contents of chamber 20, this being shown by the descending course of curve $P_s$. At the same time, the weight of the contents of hopper 16 increases (its valve 18 still being closed), this being shown by the ascending course of curve $P_t$.

The outflow of charging material from chamber 20 stops automatically when the material accumulates according to its angle of rest in hopper 16 via the communication between the chamber and the hopper, as illustrated in FIG. 1. This situation is detected by the evolution of the weight of the hopper 16 and of the chamber 20, which no longer undergoes any change after the outflow has stopped, (this being illustrated in FIG. 2 from the moment $T_1$ onwards at which the curves $P_t$ and $P_s$ take horizontal directions).

Thus, due to the separate measurement of the weight of the hopper 16 and of the chamber 20, it is possible to detect the moment $t_1$ at which the barrage has been formed which is required above the discharge aperture in the hopper 16. Valve 18 can then be opened in order to commence the true charging process. This opening action is effected at the moment $t_2$. It should be noted that up until moment $t_2$, the sum of the weights $P_t$ and $P_s$ is always equal to $P_0$, this being illustrated in FIG. 2 by the curve shown in broken lines.

As soon as valve 18 has opened, the charge material flows out of hopper 16 into the interior of the shaft furnace. The delivery of material from hopper 16 is regulated by valve 18 so that it will not exceed the delivery to hopper 16 from chamber 20. The weight of the contents of hopper 16 will remain constant as long as charging material is still present in chamber 20. This is shown by the horizontal course taken by curve $P_t$ beyond point $t_2$. Conversely, the continuous descent of curve $P_2$ illustrates the progessive discharge from chamber 20 to hopper 16. Accordingly, the total weight $P_s$ and $P_t$ also decreases from time $t_2$ onwardly, this being illustrated by the fact that the curve shown in broken lines descends parallel to curve $P_s$.

When chamber 20 is empty (at moment $t_3$), its lower sealing valve and its dosing valve 24 are closed so as to enable a further filling operation to be effected. During this time, the outflow from hopper 16 continues (this being indicated by the regular descent of the curve $P_t$ from the time $P_3$ to time $t_4$), at which it is empty in its turn.

To ensure that charging of furnace 10 is effected under optimum conditions, it is important that the barrage of material above the discharge pipe of hopper 16 is maintained throughout the charging phase. This is accomplished, for example, by adjusting dosing valve 18 so that the rate of discharge from hopper 16 is not above the rate of discharge from chamber 20. This can easily be verified from curve $P_t$. Thus, $P_t$ should remain horizontal between points $t_2$ and $t_3$, i.e. the material flowing out of hopper 16 must be replaced by that flowing from chamber 20 to hopper 16. Any correction of the position of valves 18 must be effected automatically from a signal representing a deviation of curve $P_t$ from its horizontal course.

Instead of verifying the horizontal configuration of curve $P_t$ by measuring the weight of hopper 16, it is also possible to provide (in the wall of hopper 16) level-detectors which continuously monitor the level of the barrage above the discharge pipe and provide a signal when it falls to an excessively low level, i.e. when valve 18 is opened too wide or valve 24 is not open wide enough.

Figure 3:
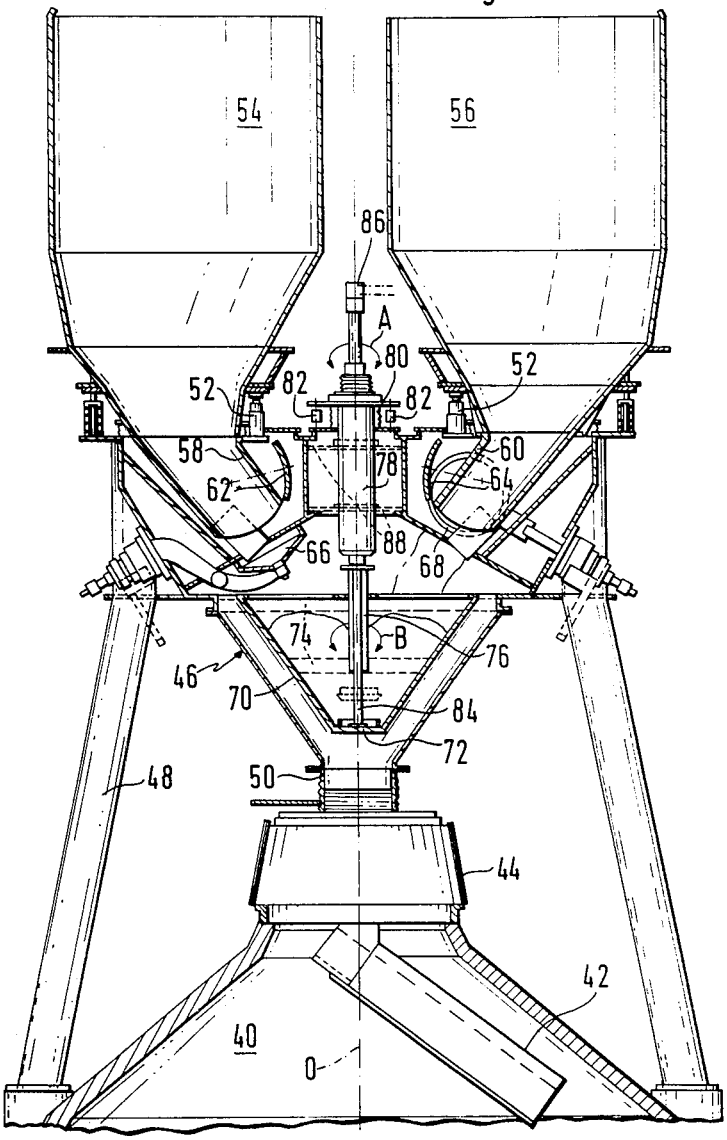
FIG. 3 is a schematic diagram, partly in axial vertical cross section, of a charging installation in accordance with one embodiment of the present invention.

FIG. 3 shows an embodiment of an installation which is designed for the performance of the process described in the foregoing and which is proving increasingly advantageous for high-capacity furnaces. The fact is that the segregation of the particles, i.e. their separation according to their grain size inside an enclosure, is a well known problem in charging installations with distributions spout. This phenomenon, is intensified in enclosures of increased diameter. This segregation problem may also arise, to a greater or smaller extent, in a hopper in which the barrage is created when the process described above is applied, particularly owing to the fact that the barrage is formed by an increase along the conical wall of the hopper and extends into the upper pipe of one of the chambers.

Referring now to FIG. 3, the upper portion of a shaft furnace is identified at 40. The head of shaft furnace 40 includes a distribution spout 42 actuated by a driving mechanism mounted in a box 44 on the furnace head 40. A tight carcase 46, generally conical in shape, is supported by a frame 48, which, in turn, is supported by furnace head 40. Carcase 46 is connected by its lower portion via a compensator 50 to box 44; and is in communication via the compensator 50 with the interior of furnace 40.

Carcase 46 supports, via a number of pressure cells 52, two chambers 54 and 56. Chambers 54 and 56 each have slanting discharge pipes 58 and 60 respectively, which extend into the interior of carcase 46. The discharge of charge material through pipes 58 and 60 is controlled by dosing devices 62 and 64. The hermeticity between each of chambers 54 and 56, the interior of the carcase 46 and the furnace 40 is ensured by two sealing valves 66 and 68 interacting with seatings mounted in carcase 46.

While in conventional charging installations employing rotary spouts, the charge material flows directly out of pipes 58 and 60 over the slanting wall of carcase 46 onto spout 42, the installation shown in FIG. 3 comprises, as a means of applying the process of the present invention described hereinabove a conical hopper 70 inside carcase 46. The lower discharge aperture of hopper 70 is controlled by a dosing device. The purpose of this dosing device is to cause a barrage of material to form in hopper 70, as described above in connection with FIGS. 1 and 2.

As a means of reducing the segregation phenomenon in hopper 70, the apparatus of the present invention comprises means for causing the hopper 70 to rotate about the vertical axis 0 of furnace 40. This rotation leads to preferred filling of hopper 70 with the filling extending over a full circle instead of forming a "blank" which gradually ascends from valve 72 to the pipes of chambers 54 and 56 and causes the segregation phenomenon to take place. However, problem caused by rotation of hopper 70 is the need for means to control the formation of the barrage by weighing the hopper 70, which never presented any problem in the systems in which it was immobile.

As a solution to this problem, hopper 70 is suspended by one or more cross bars 74 from a transverse hollow bar 76 positioned on central axis 0 and secured inside an outer coaxial cylinder 78 which passes hermetically through a bellows-type device 80 in the upper portion of carcase 46. The outside of cylinder 78 rests on a pre-selected number of pressure cells 82 which provide signals representing the weight of the hopper 70, of its contents and of all the accessories by which it is suspended from the cylinder. Bar 76 is connected, outside carcase 46, to means (not shown) which rotate it together with the hopper 70 about central axis 0, as symbolized by the arrows A and B. Dosing valve 72, which regulates the discharge from the hopper 70, is designed as a disc or bell-shaped unit which, by its vertical movement, defines with the wall of hopper 70, an annular opening of variable cross section. For this purpose, dosing device 72 is supported by the end of a bar 84 passing coaxially through bar 76 and subjected (outside the carcase 46) to the action of a jack in order to move the dosing device 72 between the closed positions shown in full lines and an open position shown in dotted lines.

To ensure a certain horizontal stability for the suspension system of hopper 70, cylinder 78 is connected by plates 88 to carcase 46. Plates 88 are sufficiently flexible so as not to interfere with the vertical freedom of movement of cylinder 78; and thus to falsify the results of the weighing operation.

It is therefore possible to weight the contents of hopper 70 while it is rotating about the vertical axis 0. The weighing of hopper 70 and one of the chambers 54 and 56 in the discharge phase makes it possible to verify and control the charging process; and particularly the operation of dosing device 72, by providing signals representing the contents of hopper 70 and those of one of the chambers 54 and 56. In other words, during the weighing operation, the chamber in the discharge phase and the hopper are treated as one single receptacle.

It will be appreciated that the weighing of hopper 70 may also serve as means for monitoring the level of its contents. Since, however, the volume and the curve for the level of the contents of the hopper may vary for one and the same weight, the filling level of the hopper should preferably be monitored by level detectors such as gauges of the ultrasonic, isotope, optical or any other gauge of this type.

The charging apparatus of the present invention allows adoption of two different methods for discharging the contents of a chamber into the furnace. Thus, in a first method, it is possible to employ a process exemplified in FIG. 2, i.e., not opening dosing device 72 until after the discharge through the pipe 60 has stopped (in other words, until after the formation of a barrage from the bottom of hopper 70 up to one of the chambers 54 or 56).

However, in a second and generally preferable method, due to the rotation of hopper 70, dosing device 72 is opened before the discharge through pipe 60 ceases, regulating dosing valves 62 and 64 of the chamber in the discharge phase, in accordance with the level of the contents of the hopper 70 (in order to maintain a constant charging level in hopper 70).

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for charging a shaft furnace having a charging installation comprising a rotary or oscillating spout, a hopper with a central discharge pipe above the spout, the discharge aperture of the discharge pipe being controlled by a dosing device operating symmetrically about the central axis of the furnace, the hopper being surmounted by at least one chamber, and a dosing device for regulating the rate of discharge to the hopper from the chamber including the steps of:

opening the dosing valve of the chamber in order to bring about the discharge of a sufficient quantity of material for the formation of a barrage of material above the discharge pipe of the hopper with the dosing valve of the hopper being closed until after the formation of said barrage;

separately weighting both the hopper and the chamber throughout the duration of the charging; and producing signals which represent, respectively, the contents of the hopper, the contents of the chamber and the sum of the contents of the hopper and the chamber whereby the signals are compared to maintain the barrage of material above the discharge pipe of the hopper until the chamber is completely discharged of material.

2. The process of claim 1 including:

adjusting the position of the dosing device of the hopper to ensure that the rate of discharge from the hopper does not exceed the rate of flow of material from the chamber to the hopper.

3. The process of claim 1 including:

maintaining the dosing device of the hopper closed until after the flow of material out of the chamber has ceased naturally as a result of the formation of the barrage ascending as far as the chamber.

4. The process of claim 2 including:

maintaining the dosing device of the hopper closed until after the flow of material out of the chamber has ceased naturally as a result of the formation of the barrage ascending as far as the chamber.

5. The process of claim 1 including:

opening the dosing device of the hopper before the natural cessation of the flow of material out of the chamber; and adjusting the position of the dosing device of the hopper wherein the barrage in the hopper will be maintained.

6. The process of claim 2 including:

opening the dosing device of the hopper before the natural cessation of the flow of material out of the chamber; and adjusting the position of the dosing device of the hopper wherein the barrage in the hopper will be maintained.

* * * * *